US005906019A

United States Patent [19]

McCarthy et al.

[11] Patent Number: 5,906,019

[45] Date of Patent: May 25, 1999

[54] AIR MATTRESS WITH OVAL BEAMS

[76] Inventors: Kevin McCarthy, 9212 Adalee Ct., Columbia, Md. 21045; Robert Brooks, 14111 Adkins Rd., Laurel, Md. 20707

[21] Appl. No.: 08/550,895

[22] Filed: Oct. 31, 1995

[51] Int. Cl.[6] ..... A47C 27/08

[52] U.S. Cl. ..... 5/710; 5/706; 5/711

[58] Field of Search ..... 5/449, 455, 457, 5/458

[56] References Cited

U.S. PATENT DOCUMENTS

| | | | |
|---|---|---|---|
| 59,945 | 11/1866 | Bauhoefer . | |
| 2,000,873 | 5/1935 | Arens | 5/348 |
| 2,345,421 | 3/1944 | Perry | 5/348 |
| 2,360,715 | 10/1944 | Perry | 5/348 |
| 2,987,735 | 6/1961 | Nail | 5/348 |
| 3,653,038 | 3/1972 | Lapidus | 5/348 |
| 3,705,429 | 12/1972 | Nail | 5/349 |
| 3,705,645 | 12/1972 | Konen | 5/644 |
| 3,740,095 | 6/1973 | Nail | 297/454 |
| 3,778,851 | 12/1973 | Howorth | 5/347 |
| 3,790,975 | 2/1974 | Philipp et al. | 5/349 |
| 3,957,557 | 5/1976 | Fraige | 5/932 |
| 4,038,447 | 7/1977 | Brock | 5/483 |
| 4,139,920 | 2/1979 | Evans | 5/420 |
| 4,193,149 | 3/1980 | Welch | 5/447 |
| 4,251,308 | 2/1981 | Miller | 5/451 |
| 4,371,999 | 2/1983 | Reid | 5/457 |
| 4,644,597 | 2/1987 | Walker | 5/468 |
| 4,662,012 | 5/1987 | Torbet | 5/455 |
| 4,896,389 | 1/1990 | Chamberland | 5/453 |
| 5,009,318 | 4/1991 | Lepinoy | 206/524 |
| 5,010,608 | 4/1991 | Barnett | 5/453 |
| 5,329,656 | 7/1994 | Leggett | 5/450 |

*Primary Examiner*—Michael F. Trettel
*Assistant Examiner*—Robert G. Santos

[57] ABSTRACT

An air mattress includes a top sheet made of woven textile material laminated to an inner sheet of PVC and welded to bottom sheet made of PVC. Oval beams are welded to the inner and bottom sheets which are joined by lap seams. Support strips are provided for securing the lap seams at each corner.

9 Claims, 2 Drawing Sheets

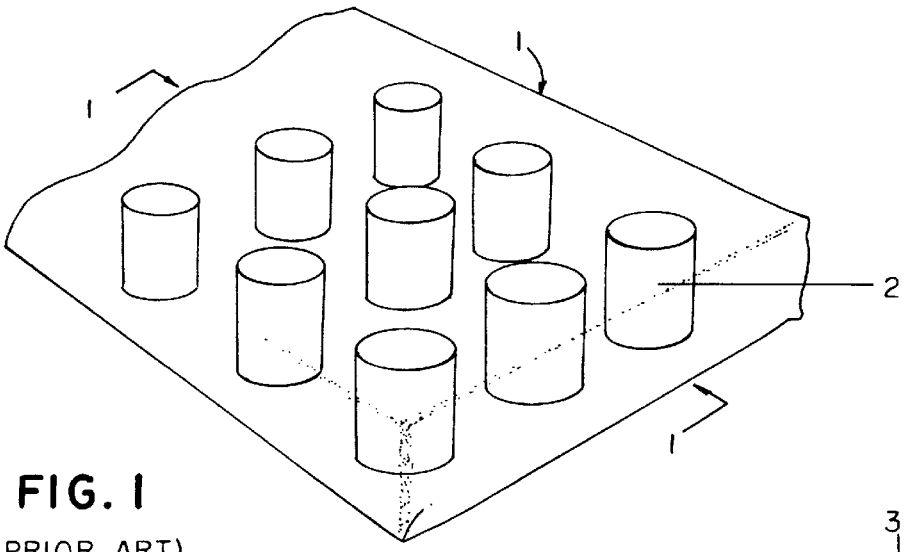
FIG. 1
(PRIOR ART)
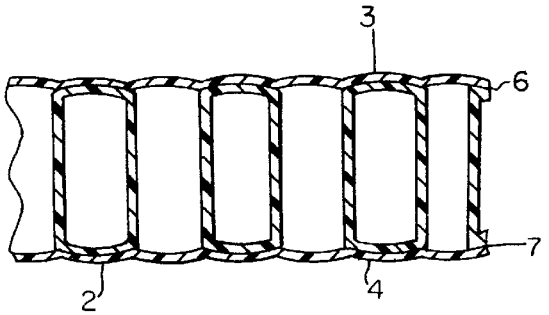
FIG. 2
(PRIOR ART)
FIG. 3
(PRIOR ART)
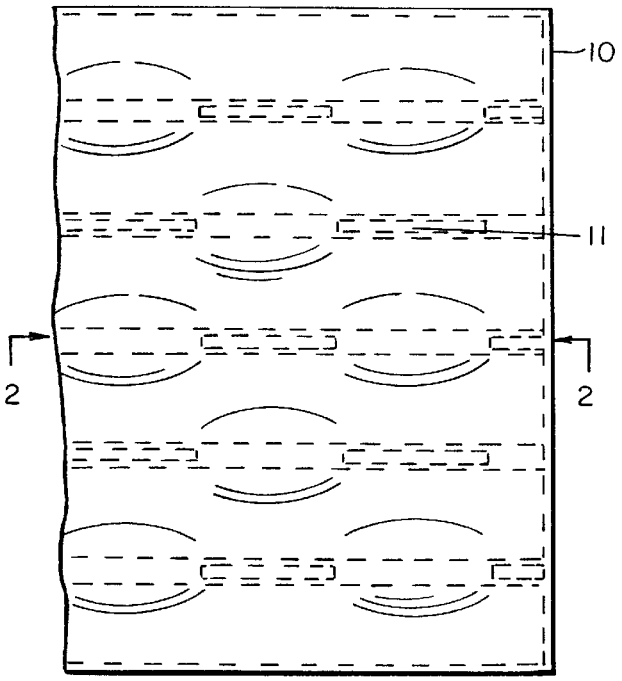
FIG. 4
(PRIOR ART)
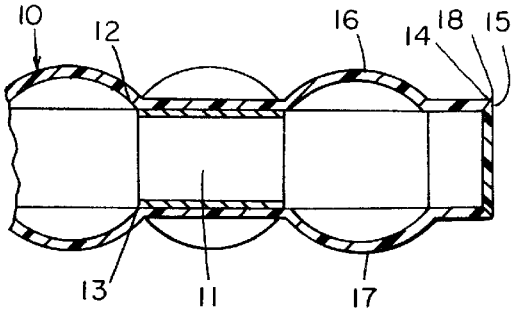

AIR MATTRESS WITH OVAL BEAMS

Currently, there are two types of air mattresses: a coil air mattress and an I-beam air mattress. These air mattresses are made of plain or flocked PVC sheeting. The flocking material used on air beds with flocked PVC is a non-woven material and consequently the flocking does not promote the strength, durability, or puncture resistance of the air mattress. The PVC sheeting has a coil or an I-beam air mattress joined by the use of butt seams or flat seams.

The prior art is shown in FIG. 1, and discloses a typical coil air mattress indicated generally at 1. Such air mattresses are made of plain PVC sheeting or flocked PVC sheeting. Such air mattresses have as their internal components a plurality of coils 2. In FIG. 2, the coil air mattress has a top sheet 3, a bottom sheet 4, and a gusset wall. The top sheet and bottom sheet are joined to the gusset wall by butt seams 6 and 7. The coils restrain the distance between the top sheet and the bottoms when the air mattress is filled with air.

In FIGS. 3 and 4, there is shown a typical I-beam air mattress indicated generally at 10. Such air mattresses are made of plain PVC sheeting. Such air mattresses may include internal components such as plurality of I-beams 11. Each I-beam terminates at I-beams indicated at 12 and 13. The top sheet is joined to the bottom sheet at 18.

Seams are also a critical component in the construction of an air mattress. Two well-known seams used in air mattresses are flat seams and butt seams. A flat seam is a stronger, more durable seam than a butt seam. Thus, the use of butt seams 6 and 7 to join the top sheet, bottom sheet and gusset wall of an air coil mattress detracts from the durability and strength of such air mattresses. In manufacturing, the welding of a plurality of coils requires the use a plurality of coil welding dies. In order to obtain a weld of optimum strength, the coil welding dies must be of exactly uniform welding height. In actual practice, the coil welding dies often are not of exactly uniform height, and weak spots are formed in the coil welds. The use of exterior butt seams and the use of a plurality of coils causes a coil air mattress to be prone to ruptures and leaks when the coil air mattress is filled with air.

The I-beam air mattress is an improvement over the coil air mattress. The use of a flat seam 18 to join the top sheet and bottom sheet adds to the strength and durability of the I-beam air mattress. The use of I-beam 11 reduces the number of welding molds needed compared to coil air mattress, thus providing consistency and strength to the weld used to join the internal components to the top and bottom sheets of the I-beam air mattress. However, with coil mattresses, coils distribute tension evenly around their circumference, whereas I-beams terminate at either end points 12 and 13. Tension cannot be distributed at end points of the I-beam which results in the end points of the I-beam becoming a pressure point and inherently prone to rupture and leaking when the I-beam air mattress is filled with air. Also, the flat seams 14 and 15 used to form the corners of the I-beam air mattress are constructed of material that is part of the top sheet 16 and the bottom sheet 17. Such flat seams are prone to pin holes and rupture at their extremities.

The U.S. Pat. Nos. to (Bauhoffer 59,945), (Arens 2,000,873), (Perry 2,345,421), (Perry 2,360,715), (Nail 2,987,735), (Nail 3,705,429), (Nail 3,740,095), (Howorth 3,778,851), (Philipp 3,790,975), (Reid 4,371,999), (Chamberland 4,896,389) and (Barnett 5,010,608) disclose prior art air beds having beams for support.

SUMMARY OF THE INVENTION

An object of the present invention is to provide an inflatable air mattress for sleeping.

A further object of the present invention is to provide a durable, reinforced air mattress for extended use.

Yet a further object of the present invention is to provide an air mattress having oval beams for rigid, underlying support.

Still a further object of the present invention is to provide an air mattress having a comfortable top sheet made of PVC backed, textile fabric material.

Another object of the present invention is to provide an air mattress having lap seams reinforced at each corner by corner strips which stabilize the overall strength of the air mattress.

The overall construction of the present air mattress provides a comfortable sleeping surface to the user and a durable mattress for everyday use. Reinforcing the corners of the mattress permits extended use of an air mattress without risk of breaking or fraying a seam.

BRIEF DESCRIPTION OF THE DRAWINGS

FIG. 1 is a perspective view of a prior art air coil mattress.

FIG. 2 is a cross sectional view of the air coil mattress taken along lines 1—1 as illustrated in FIG. 1.

FIG. 3 is a perspective view of a prior art I-beam air mattress.

FIG. 4 is a cross sectional view of the I-beam air mattress taken along lines 2—2 as illustrated in FIG. 3.

DETAILED DESCRIPTION OF THE PREFERRED EMBODIMENT

The present invention relates to an inflatable air mattress used as a surface for sleeping. The mattress of the invention can be used as such or be placed on a support surface of a conventional bed frame.

Figure 5:
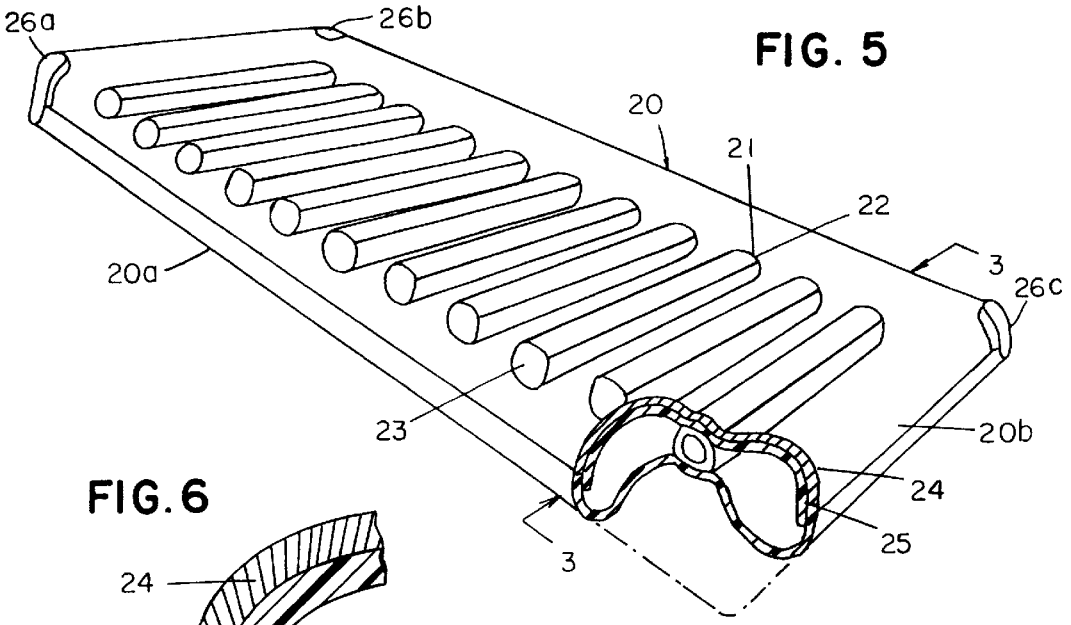
FIG. 5 is a perspective view partly broken away of a mattress constructed to embody the invention.

In FIG. 5, an inflatable air mattress 20 is illustrated in an inflated form. The air mattress 20 includes a plurality of oval-shaped beams 21 but the particular shape of the beams are not critical to the manufacturing process or end product of this invention. For example, the beams may be of square polyhedral, rectangular or cylindrical shape and may extend the length or the width of the mattress. The beams 21, for this embodiment are rounded at each end 22 and 23. The mattress also has a bottom 20*a* and sides 20*b*, as illustrated.

The mattress 20 is made from a top sheet 24 which is a woven textile fabric preferably rayon or nylon. The top sheet 24 is laminated to an inner sheet 25 which is a plastic material preferably polyvinyl chloride (PVC). The top sheet has an area which is slightly smaller than the inner sheet. At each corner 26*a*–26*d*, a piece of the top sheet has been cut out for reasons which will be explained later. The inner sheet is made with plasticizers which make the sheet soft and flexible. By laminating a textile sheet to the outer surface of the inner PVC sheet, the placticizers in the inner sheet are protected from migration due to uses with foam support frames.

Figure 6:
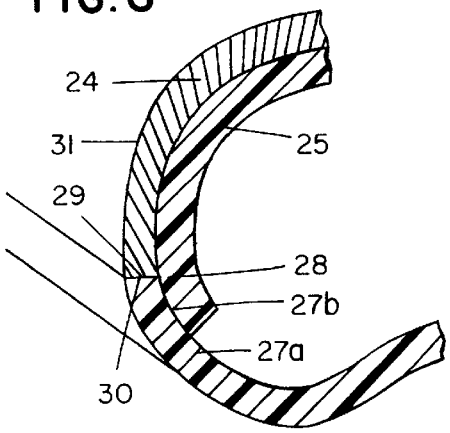
FIG. 6 is fragmentary enlarged perspective view taken alone lines 3—3 of FIG. 5.

As further illustrated in FIG. 6, the inner sheet 25 is welded to inner surface 27*a* of bottom sheet 27*b* to form a lap seam 28 which extends around the perimeter of the bed.

During the welding process, the top sheet, the inner sheet and the bottom sheet become united by the lap seam 28. The bottom sheet is smaller in area than the top sheet and even smaller in area than the inner sheet. Accordingly, edge 29 of the top sheet meets edge 30 of the bottom sheet close to the bottom of the mattress. Because the textile top sheet actually forms side walls 31, the use of the mattress in a foam support frame will not preempt the life of the mattress because of plasticizer migration to the foam. Moreover, the textile material is less likely to make rubbing noises than the prior art mattresses made of plastic.

The lap seam 28 is equally an important part of the invention. The lap seam is formed near the bottom of the mattress but along the sides. Because of the location near the bottom, the mattress may support greater amounts of weight because there is less formed in the middle of the side or on top. Since the inner sheet overlaps the bottom sheet and is welded to the inner surface of the bottom sheet an even stronger seam is created.

Figure 8:
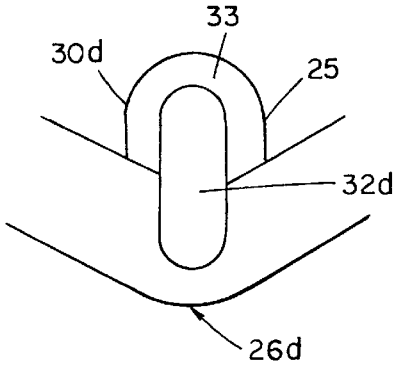
FIG. 8 is an enlarged view of the corner of the mattress.
Figure 7:
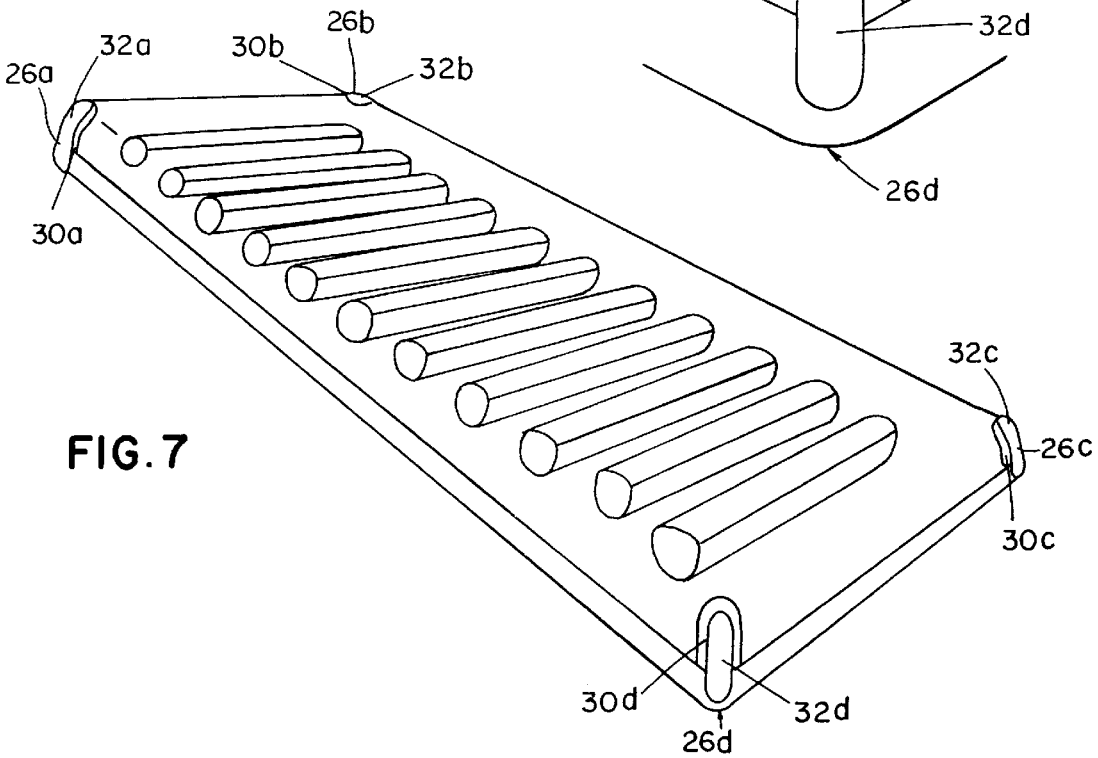
FIG. 7 is a perspective view of the mattress of the present invention.

FIGS. 7 and 8 further illustrate the present air mattress. Each corner 26*a*–26*d* has an area cutout of the top sheet as indicated at 30*a*–30*d* exposing top surface 33 of inner sheet 25. Overlapping the lap seam at each corner cutout 30*a*–30*d* is a support strip 32*a*–32*d*. Each support strip is welded to the mattress to provide an even stronger support seam. The strips are made of thick PVC material.

The oval beams are welded to the inner sheet and to the bottom sheet. Each beam includes air inlets for receiving air during inflation of the mattress. A standard air inlet nozzle and plug is provided in the bottom sheet for inflation but is not illustrated.

The air mattress is inflated with air and expands to produce a sleeping support surface for everyday use. The air mattress is constructed for use with foam frames and provides novel aspects not before provided by prior art air mattresses. The use of an extended textile top sheet backed by a PVC inner sheet which is lapped seamed to a bottom PVC is great improvement over air mattresses previously used. The novel support strips which are directly welded to the inner sheet and the bottom sheet significantly improves the structural stability of the mattress.

While very simple forms of the invention have been described, it will be understood that the invention has wide application and various modifications of structure may be made by those skilled in the art without departing from the spirit of the invention or scope of the appended claims.

We claim:

1. An inflatable air mattress for use in a foam support frame, said air mattress comprising:

a woven textile top sheet, said woven textile top sheet extended to form side walls, said woven textile top sheet have an edge;

an inner plastic sheet, said inner plastic sheet made with plasticizers to make said inner plastic sheet soft and flexible, said inner plastic sheet laminated to said woven textile top sheet and extending beyond said edge;

a plurality of beams; and, a bottom plastic sheet, said bottom plastic sheet having a bottom edge, said bottom plastic sheet smaller in area than said woven textile top sheet and said inner plastic sheet, said woven textile top sheet, said inner plastic sheet and said bottom plastic sheet united by a lap seam, said woven textile top sheet edge mating with said bottom edge near said lap seam and close to the bottom of said mattress to prevent plasticizer migration to said foam support frame, said plurality of beams welded to said inner plastic sheet and said bottom plastic sheet.

2. The air mattress of claim 1 in which the woven textile material is nylon.

3. The air mattress of claim 1 in which the woven textile material is rayon.

4. The air mattress of claim 1 further comprising corners, said corners having support strips, each support strip welded to said inner plastic sheet and said bottom plastic sheet for supporting each corner of said air mattress.

5. The air mattress of claim 4 in which the woven textile is nylon.

6. The air mattress of claim 4 in which the woven textile is rayon.

7. An inflatable air mattress for use in a foam support frame, said air mattress comprising:

a woven textile top sheet, said woven textile top sheet extended to form side walls, said woven textile top sheet have an edge;

an inner plastic sheet, said inner plastic sheet made with plasticizers to make said inner plastic sheet soft and flexible, said inner plastic sheet laminated to said woven textile top sheet and extending beyond said edge;

a plurality of beams; and, a bottom plastic sheet, said bottom plastic sheet having a bottom edge, said bottom plastic sheet smaller in area than said woven textile top sheet and said inner plastic sheet, said woven textile top sheet, said inner plastic sheet and said bottom plastic sheet united by a lap seam, said woven textile top sheet edge mating with said bottom edge near said lap seam and close to the bottom of said mattress to prevent plasticizer migration to said foam support frame, said plurality of beams welded to said inner plastic sheet and said bottom plastic sheet; and, corners, said corners having support strips, each support strip welded to said inner sheet and said bottom sheet for supporting each corner of said air mattress.

8. The air mattress of claim 7 in which the woven textile material is nylon.

9. The air mattress of claim 7 in which the woven textile material is rayon.

* * * * *